US005980006A

United States Patent [19]

Wilhelmstätter et al.

[11] Patent Number: 5,980,006

[45] **Date of Patent: *Nov. 9, 1999**

[54] DEVICE FOR WEIGHT COMPENSATION OF A FRONT END DOOR OF A HOUSEHOLD APPLIANCE, ESPECIALLY A HOUSEHOLD DISHWASHER, THE DOOR BEING SUPPORTED ON A HOUSING AND PIVOTABLE ABOUT A HORIZONTAL AXIS

[75] Inventors: Johann Wilhelmstätter, Giengen/Hürben; Helmut Jerg, Giengen; Bernd Schessl, Dillingen; Gerhard Fetzer, Gundelfingen; Michael Hartmann, Höchstädt; Markus Höpfl, Lauingen/Donau; Karl-Heinz Rehm, Dischingen; Rudolf Schmidt, Giengen, all of Germany

[73] Assignee: BSH Bosch und Siemens Hausgeraete GmbH, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,033

[22] Filed: Mar. 20, 1997

[30] Foreign Application Priority Data

Mar. 20, 1996 [DE] Germany ..... 196 11 050

[51] Int. Cl.[6] ..... A47B 88/00; E06B 3/30

[52] U.S. Cl. ..... 312/319.1; 312/319.4; 312/327; 126/191; 126/194

[58] Field of Search ..... 312/319.1, 319.2, 312/319.4, 325, 326, 327, 228, 311; 16/286, 289, 306; 126/191, 194; 49/371

[56] References Cited

U.S. PATENT DOCUMENTS

| | | | |
|---|---|---|---|
| 2,198,348 | 4/1940 | Little | 126/194 X |
| 2,237,795 | 4/1941 | Shroyer | 126/191 |
| 2,264,059 | 11/1941 | Weimer et al. | 126/191 |
| 2,550,161 | 4/1951 | Pearce | 126/191 |
| 2,731,011 | 1/1956 | Maier | 126/194 X |
| 2,921,575 | 1/1960 | Fry | 126/191 |
| 3,006,335 | 10/1961 | Keeling, Sr. | 126/191 |
| 3,046,974 | 7/1962 | Kimbereley | 126/191 |
| 3,049,114 | 8/1962 | Carnahan et al. | 126/191 |
| 4,853,985 | 8/1989 | Perry | 16/289 X |

FOREIGN PATENT DOCUMENTS

| | | | |
|---|---|---|---|
| 14114 | 8/1980 | European Pat. Off. | 312/311 |
| 2929526 | 2/1981 | Germany | 312/319.1 |
| 3911555 | 10/1990 | Germany . | |
| 683886 | 6/1994 | Switzerland | 312/319.1 |

OTHER PUBLICATIONS

German Publication GM 83, 29, 611, (Abstract & Figure), Jul. 1984.

*Primary Examiner*—Peter M. Cuomo
*Assistant Examiner*—James O. Hansen
*Attorney, Agent, or Firm*—Herbert L. Lerner; Laurence A. Greenberg

[57] ABSTRACT

In order to provide a device (10) for balancing the weight of a front door (2), mounted on a casing (1) so as to be pivotable about a horizontal axis (3), of a domestic appliance, in particular a domestic dishwasher, which device is connected by a tape or cord-shaped transmission member (11) to a tension spring (5) fastened to the casing (1), said transmission member resting under tension on a deflection roller (17) arranged on a carrier (12) fastened to the casing (1), in which, in a simple manner, simple and rapid adjustment of the spring force is made possible for the user, according to the invention there is a device, for acting on the transmission means (11), which cause a change in the overall length of the assembly of tension spring (5) and transmission member (11).

13 Claims, 1 Drawing Sheet

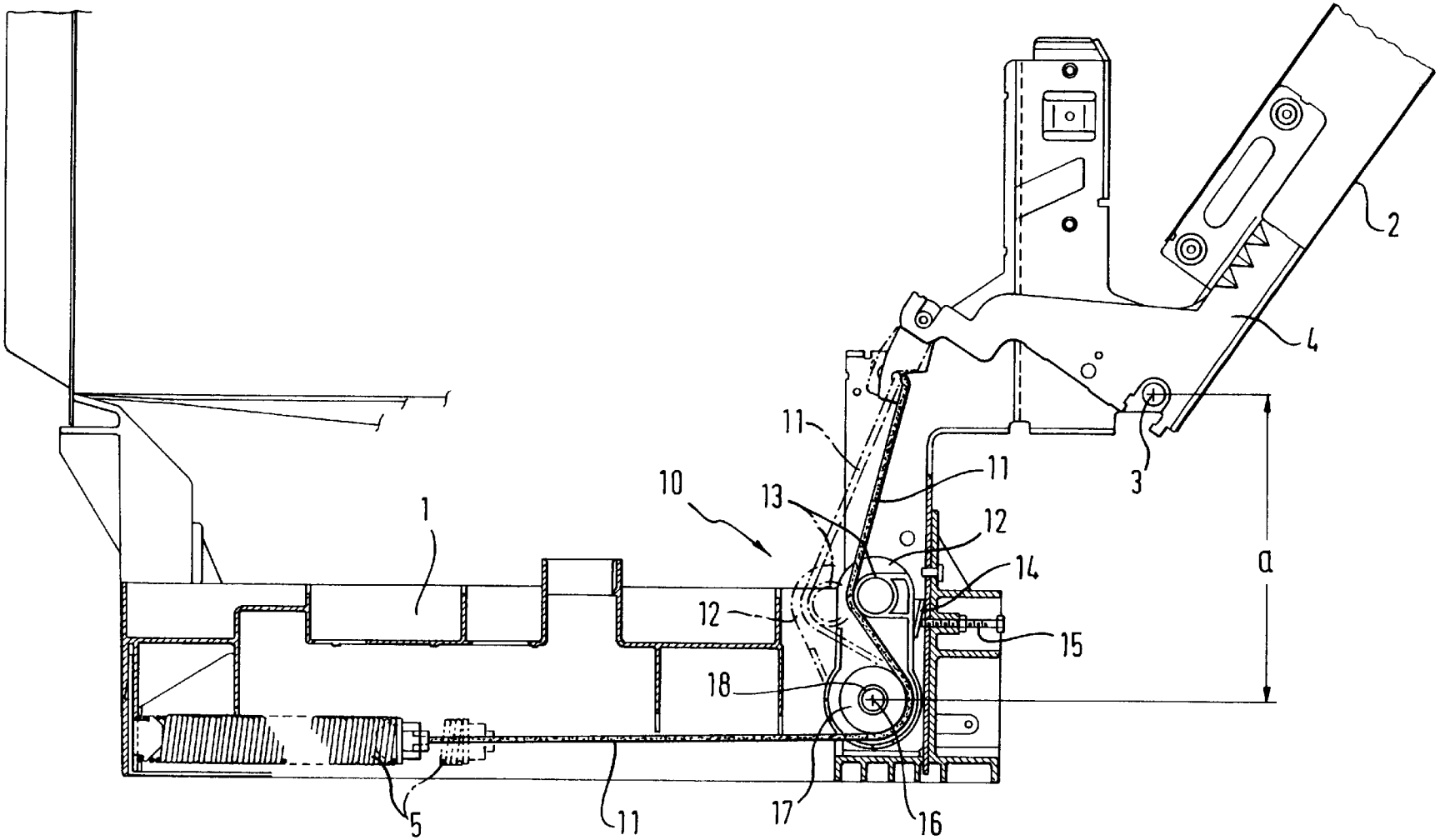
2
4
a
3
15
14
12
11
16
11
13
17
10
12
18
11
1
5

DEVICE FOR WEIGHT COMPENSATION OF A FRONT END DOOR OF A HOUSEHOLD APPLIANCE, ESPECIALLY A HOUSEHOLD DISHWASHER, THE DOOR BEING SUPPORTED ON A HOUSING AND PIVOTABLE ABOUT A HORIZONTAL AXIS

The invention relates to a device for balancing the weight of a front door, mounted on a casing so as to be pivotable about a horizontal axis, of a domestic appliance, in particular a domestic dishwasher, which device is connected by means of a tape or cord-shaped transmission means to a tension spring fastened to the casing, said transmission means resting under tension on a deflection roller arranged on a carrier fastened to the casing.

DE-U 74 32 124 discloses a device for balancing the weight of a front door, mounted on a casing so as to be pivotable about a horizontal axis, of a domestic appliance, in particular a domestic dishwasher, which is connected by means of a tape or cord-shaped transmission means to a tension spring fastened to the casing. It is known, for example in domestic dishwashers which can be installed into kitchen units, to fasten a decor panel to the door, in order to obtain a uniform kitchen unit front. In this case, the weight of the door changes, so that in the case of such devices it becomes necessary to allow adjustability of the spring tension. The device according to the abovementioned publication has no possibility for adjusting the spring force.

In DE-C 39 11 555, for a device of the type mentioned at the beginning, an adjustability of the spring fastening by means of various attachment points of the tension spring is proposed. Since the tension springs are under very high tension, attachment and reattachment of the tension spring, which is poorly accessible in the lower region of such a domestic appliance, is not reasonable for the user.

For a device for balancing the weight of a front door, mounted on a casing so as to be pivotable about a horizontal axis, of a domestic appliance, in which the tension spring, fastened to the casing by means of an angled lever, is attached directly to the door, DE-U 83 29 611 discloses pivoting the angled lever by means of a setting screw arranged on the casing, in order to enable a possible adjustment of the spring force which is simple for the user. This arrangement has the disadvantage that a relatively large pivoting of the angled lever is necessary even for a slight adjustment of the spring force.

The invention is therefore based on the object of providing a device as mentioned at the beginning in which, in a simple manner, simple and rapid adjustment of the spring force is made possible for the user.

According to the invention, this object is achieved in that there are arranged means, for acting on the transmission means, which cause a change in the overall length of the assembly of tension spring and transmission means.

As a result of the action on the tape or cord-shaped transmission means, a device as mentioned at the beginning is provided in which, in a simple way, simple and rapid adjustment of the spring force is made possible for the user. Since the transmission means is always tensioned, because of the spring force, and hence wraps around the deflection roller by a fixed wrap-around angle, because of the arrangement, each action on the transmission means which displaces the latter out of the predetermined wrap-around angle of the deflection roller leads to a lengthening of the assembly of transmission means and tension spring which, since the transmission means is not substantially expansible, leads to an expansion of the tension spring and hence to an increase in the spring force, and each opposing action, after a lengthening of the assembly has already been set, leads to relieving of the tension spring and hence to a reduction in the spring force. It has been shown in practice that using this arrangement, a relatively large adjustment of the spring force is already achieved with a slight action on the transmission means.

According to a preferred embodiment of the invention, the transmission means rests on the carrier which is pivotably mounted on the casing. This embodiment provides a particularly simple and effective means for acting on the transmission means according to the invention.

In order to make the action on the transmission means still more effective, the pivot of the carrier is advantageously arranged at a vertical distance which is as far as possible from the door mounting axis.

Simple operation by the user is moreover improved by the carrier expediently being pivoted by means of a setting screw, which is arranged on the casing and rests on an end of the carrier which is other than the pivot of the carrier, in the direction of the door.

According to an advantageous embodiment of the invention, the door, the tension spring, the carrier, the setting screw and the deflection roller are arranged in and/or on a machine base, which achieves a simple construction of the domestic appliance having the device according to the invention.

A further simplification of the acting means according to the invention is provided by the deflection roller being rotatably mounted on the pivot of the carrier, whereby only one common bearing point for the carrier and the deflection roller becomes necessary.

The transmission means is preferably a cord produced from a thermoplastic. It has been shown in practice that, for example, steel cords wear more rapidly than plastic cords in the case of the type of loading as a result of the device according to the invention.

A transmission means (11) which is a braided cord made of polyester has been shown to be particularly durable in practice.

The transmission element preferably rests on a projecting bearing pin of the carrier on the side opposite the setting screw, the carrying along of the transmission element when adjusting the carrier being further simplified thereby.

The invention is explained below using an exemplary embodiment illustrated in the drawing.

Illustrated in the single FIGURE is a section through a machine base 1, which is a part of a casing of a domestic dishwasher, which is not explained in more detail, in which there is arranged a device 10 according to the invention for balancing the weight.

The domestic dishwasher has a front door 2 which is mounted in the machine base 1 so as to be pivotable about a horizontal axis 3. This door 2 is connected, in a manner not described in more detail, to both sides of the front side of the machine base 1, in each case by means of a hinge 4 connected to the door 2. The device 10 according to the invention for balancing the weight comprises a tension spring 5, which is fastened in the machine base 1, and is connected to the door 2, or in the exemplary embodiment to the hinge 4, by means of a tape or cord-shaped transmission means 11, in the exemplary embodiment shown by means of a cord 11 made of a thermoplastic, preferably a braided cord 11 made of polyester. This cord 11 rests under tension on a deflection roller 17 which is arranged in a carrier 12 fastened in the machine base 1, and partially wraps around said deflection roller.

According to the invention, there are provided means for acting on the transmission means 11. These means are, in the exemplary embodiment described, the carrier 12, which has a projecting bearing pin 13, and a setting screw 15 arranged on the machine base 1. The cord 11 rests on the bearing pin 13 of the carrier 12, on the side opposite the setting screw 15. The carrier 12 is mounted pivotably on the machine base 1, the pivot 16 of the carrier 12 being arranged at a vertical distance a which is as far as possible from the door mounting axis 3. The setting screw 15 rests on an end of the carrier 12 which is other than the pivot 16 of the carrier 12, in the direction of the door 2, for which purpose the carrier 12 has a bearing surface 14.

The deflection roller 17 is rotatably mounted on the pivot 16 of the carrier 12. The pivot 16 of the carrier 12 is formed by a bearing bolt 18 fastened to the machine base 1, on which bearing bolt the deflection roller 17 is also rotatably mounted.

In order to increase the force of the tension spring 5, for example when a decor panel is fastened to the door 2 in order to match the domestic dishwasher to a kitchen unit front, the weight of the door 2 which is to be balanced being changed, of course, the setting screw 15 is screwed in in the direction of the carrier 12, coming into contact with the bearing surface 14 of the carrier 12, and the latter being pivoted in the direction of the interior of the machine base 1, about the bearing bolt 18 forming the pivot 16 of the carrier 12, the cord 11 being carried along because of the cord 11 resting on the bearing pin 13. As a result of this inventive action on the transmission means 11, in the exemplary embodiment on the cord 11, the latter is displaced out of the wrap-around angle of the deflection roller 17 which is predetermined by the selected arrangement, that is to say out of the wrap-around angle without the action of the setting screw 15, that is to say out of the wrap-around angle in the rest position, which leads to a lengthening of the assembly of cord 11 and tension spring 5 and as a result of which, since the cord 11 is not substantially expansible, an expansion of the tension spring 5 and hence an increase in the tension spring force is achieved. In the single FIGURE, the device 10 according to the invention is shown with continuous lines in the rest position and with dashed lines in the maximum pivoted position.

If, after a spring force increase has already been set once, the spring force is to be set weaker once more, then the setting screw 15 is appropriately screwed out of the machine base 1, which leads to a shortening of the assembly of cord 11 and tension spring 5 and hence to a shortening of the tension spring 5, which results in a reduction in the spring force. Therefore, the opposite action according to the invention on the transmission means 11, in the exemplary embodiment shown on the cord 11, leads to a reduction in the spring force.

The above-described device 10 according to the invention for balancing the weight of a front door 2, mounted on a casing so as to be pivotable about a horizontal axis 3, of a domestic appliance, in particular a domestic dishwasher, provides a device 10 in which, in a simple manner, simple and rapid adjustment of the spring force is possible for the user.

We claim:

1. A domestic appliance comprising:

a casing;

a front door pivotable about a horizontal axis;

a deflection roller rotatably mounted about an axis;

a tension assembly for balancing a weight of said front door, said tension assembly including a tension spring fastened to said casing and a transmission element connecting said tension spring to said door, said transmission element resting under tension on said deflection roller;

a device mounted for movement to a plurality of fixed lateral positions with respect to said casing and mounted against said transmission element for effecting a change in an overall length of said tension assembly formed by said tension spring and said transmission element; and an adjustable element mounted against said device for moving said device to said plurality of fixed lateral positions with respect to said casing.

2. The domestic appliance according to claim 1, wherein the transmission element is a tape.

3. The domestic appliance according to claim 1, wherein the transmission element is a cord.

4. The domestic appliance according to claim 3, wherein the transmission element is a thermoplastic cord.

5. The domestic appliance according to claim 3, wherein the transmission element is a braided polyester cord.

6. The domestic appliance according to claim 1, wherein said adjustable element is a setting screw.

7. A domestic appliance comprising:

a casing;

a front door pivotable about a horizontal axis;

a carrier pivotally mounted about a carrier pivot axis;

a deflection roller rotatably mounted about said carrier pivot axis;

a tension assembly for balancing a weight of said front door, said tension assembly including a tension spring fastened to said casing and a transmission element connecting said tension spring to said door, said transmission element resting under tension on said deflection roller;

a device mounted in said carrier remote from said carrier pivot axis, said device pivotable about said carrier pivot axis to a plurality of fixed positions and disposed against said transmission element for effecting a change in an overall length of said tension assembly formed by said tension spring and said transmission element; and an adjustable element mounted against said carrier for pivoting said device about said carrier pivot axis to said plurality of fixed positions.

8. The domestic appliance according to claim 7, wherein the carrier pivot axis is disposed at a maximum allowable vertical distance from the pivot axis of the door.

9. The domestic appliance according to claim 7, wherein the deflection roller is rotatably mounted about said pivot axis of said carrier.

10. The domestic appliance according to claim 7, wherein said adjustable element is a setting screw.

11. A domestic appliance comprising:

a casing;

a front door pivotable about a horizontal axis;

a carrier pivotally mounted about a carrier pivot axis;

a deflection roller rotatably mounted about said carrier pivot axis;

a tension assembly for balancing a weight of said front door, said tension assembly including a tension spring fastened to said casing and a transmission element connecting said tension spring to said door, said transmission element resting under tension on said deflection roller;

a device acting on said transmission element for effecting a change in an overall length of said tension assembly formed by said tension spring and said transmission element; and a setting screw for pivoting said carrier, said setting screw supported on said casing and offset from said carrier pivot axis in a direction toward said front door.

12. The domestic appliance according to claim 11, which further comprises a machine base support, and wherein the door, the tension spring, said carrier, said setting screw and the deflection roller are disposed in said machine base.

13. The domestic appliance according to claim 11, which further comprises a projecting bearing pin on said carrier disposed on a side opposite said setting screw.

* * * * *